US007007604B2

(12) United States Patent
Momot

(10) Patent No.: US 7,007,604 B2
(45) Date of Patent: Mar. 7, 2006

(54) INTEGRATED INK RAIL ASSEMBLY FOR A PRINTING PRESS

(75) Inventor: Stanley Momot, La Grange, IL (US)

(73) Assignee: Goss International Corporation, Bolingbrook, IL (US)

( * ) Notice: Subject to any disclaimer, the term of this patent is extended or adjusted under 35 U.S.C. 154(b) by 104 days.

(21) Appl. No.: 10/423,426

(22) Filed: Apr. 25, 2003

(65) Prior Publication Data

US 2003/0230207 A1 Dec. 18, 2003

Related U.S. Application Data

(60) Provisional application No. 60/375,382, filed on Apr. 25, 2002.

(51) Int. Cl.
*B41F 3/02* (2006.01)

(52) U.S. Cl. ..... 101/366; 101/365; 101/350.1

(58) Field of Classification Search ..... 101/366, 101/365, 350.1, 350.6, 364, 348, 349.1
See application file for complete search history.

(56) References Cited

U.S. PATENT DOCUMENTS 3,796,155 A * 3/1974 Schluckebier ..... 101/365
5,410,961 A 5/1995 DeNicola et al.
5,472,324 A 12/1995 Atwater
5,560,294 A * 10/1996 Anders et al. ..... 101/366
6,513,430 B1 2/2003 Atwater

FOREIGN PATENT DOCUMENTS

EP 0 607 574 A1 12/1993

OTHER PUBLICATIONS

International Search Report in International (PCT) Application No. PCT/US 03/12788 dated Sep. 25, 2003.

* cited by examiner

*Primary Examiner*—Ren Yan
*Assistant Examiner*—Leo T. Hinze
(74) *Attorney, Agent, or Firm*—Marshall, Gerstein & Borun LLP

(57) ABSTRACT

An integrated ink rail assembly includes at least one page pack mounted directly to a manifold, an ink rail mounted to the manifold, and an orifice rail mounted to the ink rail. An ink source is connected to the page pack. The page pack, manifold, ink rail, and orifice rail define a plurality of ink passages to deliver ink from the ink source to a drum. The ink passage may be directed towards the middle of the assembly such that a web smaller than the page pack can be printed.

34 Claims, 17 Drawing Sheets

INTEGRATED INK RAIL ASSEMBLY FOR A PRINTING PRESS

FIELD OF THE INVENTION

The present invention relates generally to printing presses and, more particularly, to an integrated injector rail assembly for delivering ink to a drum on a printing press.

BACKGROUND OF THE INVENTION

In a conventional lithographic printing press, ink or an ink emulsion is supplied to a drum using a print unit. As is known, the ink is typically ultimately transferred to a plate cylinder via a number of intermediate drums or cylinders. As shown in FIG. 1, a typical print unit 10 can include a page pack 12 and an ink rail assembly 14. The page pack 12 includes an ink inlet 16, a pump 18, and a control valve 20. The page pack 12 pumps the ink through a plurality of supply lines 22 under pressure to the ink rail assembly 14, which is mounted closely adjacent to a drum 24. Each of the supply lines 22 is typically a length of tubing or flexible hose. The ink rail assembly 14 typically includes an ink rail 26 having a number of orifices 28. The orifices 28 are spread out along the length of the ink rail 26 and are adapted to deliver ink to the drum 24. Thus, ink is pumped from the page pack 12 through a length of supply line 22 to the ink rail 26 and through the orifices 28, such that the ink is applied directly to the surface of the drum 24.

In a conventional printing press there are typically a number of print units. Further, there are typically two drums for each print unit with at least one ink rail assembly for each drum. Thus, the ink may be supplied to each of the ink rail assembly through a system of supply lines and/or headers.

Such a conventional arrangement may have a number of disadvantages. Some of these disadvantages may include, for example, that it is difficult to switch web sizes without having to replace the entire ink rail. Further, on a conventional system it is very difficult to purge the ink from the system due to the length of the supply lines, making color changeovers more costly due to increased purge time and wasted ink that is stored in the lengthy supply system. Finally, on a conventional arrangement there is much duplication of hardware, such as multiple hose assemblies and multiple sets of mounting systems.

DETAILED DESCRIPTION

The embodiments described herein are not intended to be exhaustive or to limit the scope of the invention to the precise form or forms disclosed. Instead, the following embodiments have been described in order to best explain the principles of the invention and to enable others skilled in the art to follow its teachings.

Figure 1:
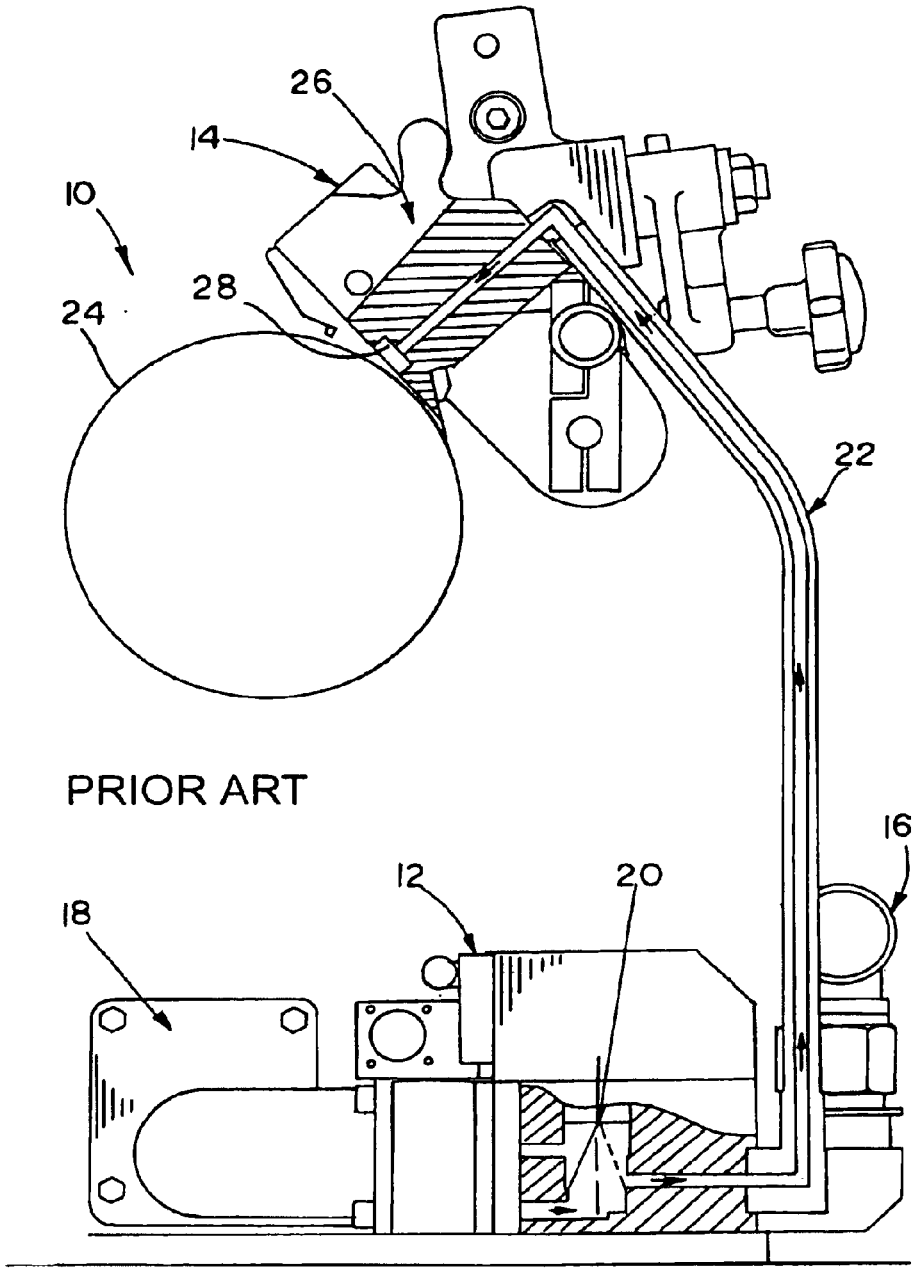
FIG. 1 is a schematic elevational view of a prior art conventional ink or emulsion ink supply system.
Figure 2:
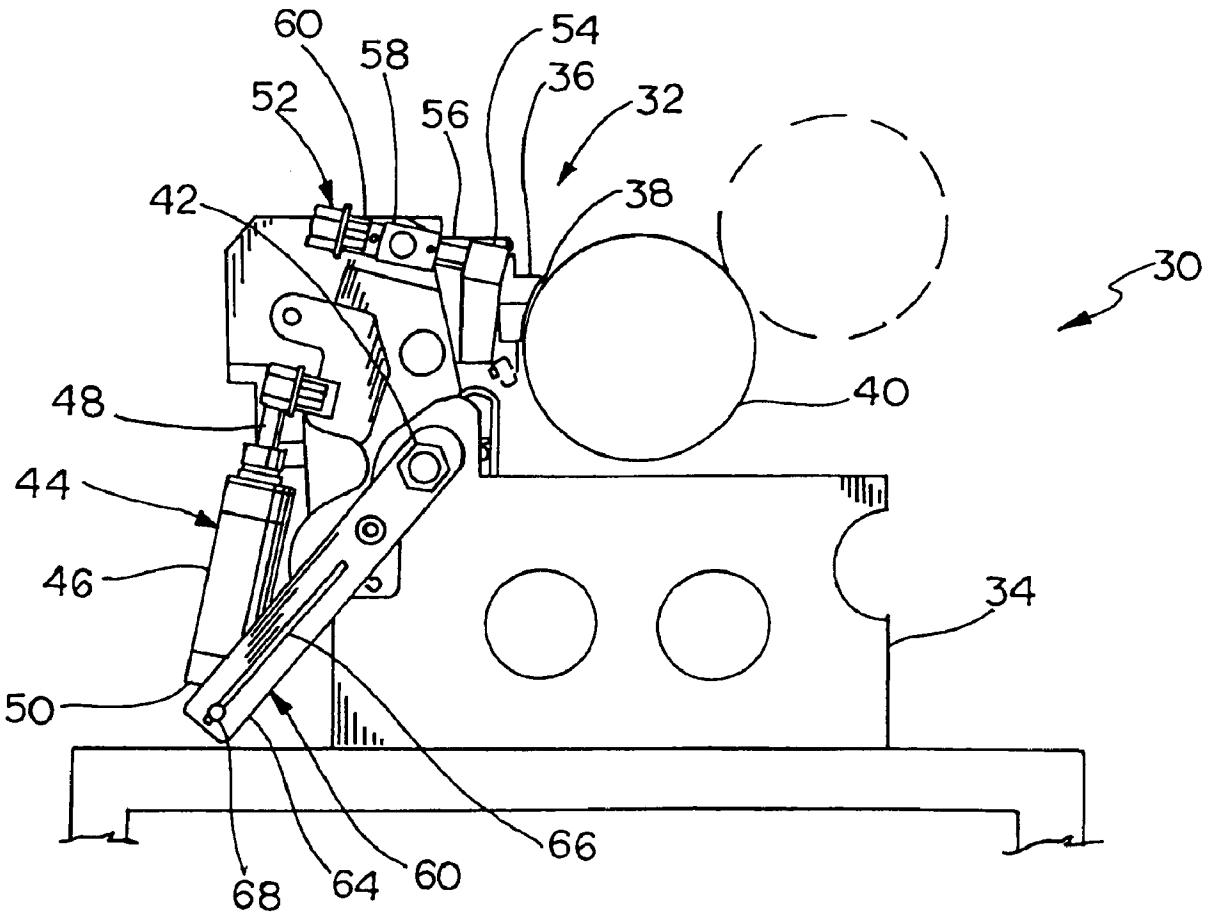
FIG. 2 is fragmentary elevational view of a printing press assembled in accordance with the teachings of the present invention attached thereto.

Referring now to the drawings, FIG. 2 illustrates a printing press assembled in accordance with the teachings of this disclosure and which is generally referred to by the reference numeral 30. The press 30 depicted in FIG. 2 shows a single print unit 32 capable of printing an ink on a web (not shown). However, a press 30 may employ a plurality of print units 32, each capable of printing an ink on the same web for multi-color prints. For purposes of convenience, the term ink is used repeatedly herein. However, it will be understood that the term ink may also encompass an emulsion ink and water solution as is commonly employed in printing processes.

Each print unit 32 includes a frame 34, an ink rail assembly 36 with an ink delivery face 38, and transfer drum 40. A printing press 30 with a plurality of print units 32 will typically employ a number of drums 40 and ink rail assemblies 36. The frame 34 is used to locate and support the ink rail assembly 36 and the drum 40. The ink rail assembly 36 is rotatably mounted to the frame 34 about a pivot point 42. The drum 40 is rotatably mounted to the frame 34 in a manner known in the art.

As is commonly known, the ink rail assembly 36 delivers ink to the transfer drum 40, which may then deliver the ink to a series of intermediate drums (one of which is shown in hidden lines). Ultimately, the ink is transferred to a plate cylinder which prints the ink on a passing web in a manner known in the art.

Referring again to FIG. 2, the ink rail assembly 36 is movable from a work position, shown in FIG. 2, in which the ink rail assembly 36 is adjacent the transfer drum 40, to a service position (not shown) in which the ink rail assembly 36 is thrown off the drum. The print unit 32 further includes an actuator 44, which moves the ink rail assembly 36 from the work position to the service position and vice versa. In this case the actuator 44 is shown as a hydraulic cylinder 46 that includes a movable shaft 48. The first end 50 of the cylinder 46 is fixed to the frame 34, and the movable shaft 48 is fixed to the rotatable ink rail assembly 36. Other actuators 44 such as automated jack screws or pneumatic cylinders can easily be substituted.

In the work position, the ink rail assembly 36 delivers ink to the adjacent drum 40. When the print unit 32 requires servicing, the actuator 44 is activated which then pulls the movable shaft 48 into the cylinder 46, such that the ink rail assembly 36 is rotated about the pivot point 42 and the ink delivery face 38 is pulled away from the drum 40. The ink rail assembly 36 is thereby accessible for servicing.

A suitable control system (not shown) may include a pressurized hydraulic fluid source, a system of supply lines for routing hydraulic fluid to the actuators, and a control line arranged to route a suitable control signal from a controller (not shown) to the system for controlling the actuators in a conventional manner. Other types of suitable actuation and control systems may be employed.

The print unit 32 includes a fine adjustment locator 52 with a head 54. The frame 34 includes a strike plate (not shown). When the ink rail assembly 36 is moved from the service position to the work position, the head 54 contacts the strike plate, thereby stopping the advancement of the ink rail assembly 36 and positively locating the ink rail assembly 36 with respect to the drum 40.

The fine adjustment locator 52 is adjustable to accurately determine the lcoation the ink rail assembly 36 stops. The fine adjustment locator 52 includes an externally threaded rod 56, a complementary internally threaded tube 58, and a nut 60. To adjust the location of the stopping point, the threaded rod 56 is rotated within the tube 58. The nut 60 can then be secured tightly against the end of the tube 58 to lock the fine adjustment locator 52 in place. As is known, the farther the head 54 extends out the internally threaded tube 58, the further the ink rail assembly 36 will be stopped from the drum 40.

Further, a course adjustment locator 62 is also provided. An extension 64 is attached at one end to the frame 34. A slot 66 is disposed along the length of the extension 64. The actuator 44 is attached to the extension 64 in this example by tightening a bolt 68 fastened to the actuator 44 within the slot 66. Thus, with the bolt 68 loosened, the bottom of the actuator 44 can be slid up and down the slot 66. The further up the slot 66 the actuator 44 is located, the closer the ink rail assembly 36 will be rotated to the drum 40. Once the proper location of the actuator 44 is determined, the bolt 68 can be tightened.

Figure 3:
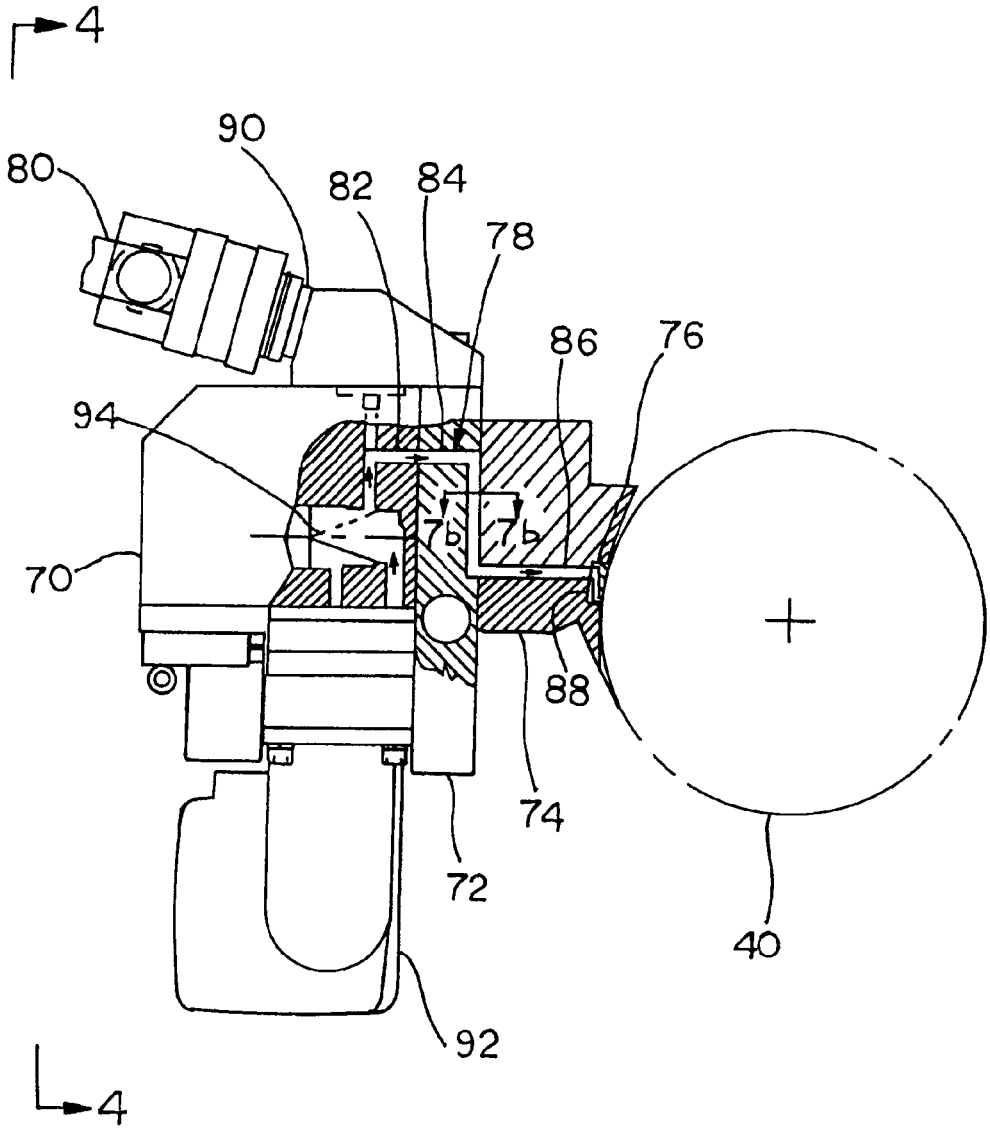
FIG. 3 is a schematic elevational view of an integrated ink supply system assembled in accordance with the teachings of the present invention.

Turning to FIG. 3, the ink rail assembly 36 includes a page pack 70 that is mounted in fluid communication to a manifold 72 that is in turn mounted in fluid communication to an ink rail 74. An orifice rail 76 is mounted in fluid communication to the ink rail 78. The page pack 70, manifold 72, ink rail 74 and orifice rail 76 together define an overall ink passage 78 for transfering ink from a supply conduit 80 and delivering it to the drum 40. The page pack 70, the manifold 72, the ink rail 74, and the orifice rail 76 each individually include ink paths 82, 84, 86, and 88 respectively.

The page pack 70 includes an ink inlet 90 operatively connected to an ink supply (not shown) via the supply conduit 80. A pump 92 pulls the ink from the supply conduit 80 through the ink passage 78 and through a valve 94 which regulates the supply of ink.

The pump 92 then pushes the ink along the ink passage 78 through the manifold 72, ink rail 74, and orifice rail 76 and out to the drum 40. As is known, the ink is applied to the drum 40, from where the ink is ultimately transferred through a series of intermediate transfer drums to a plate cylinder and then a web as is known.

Figure 4:
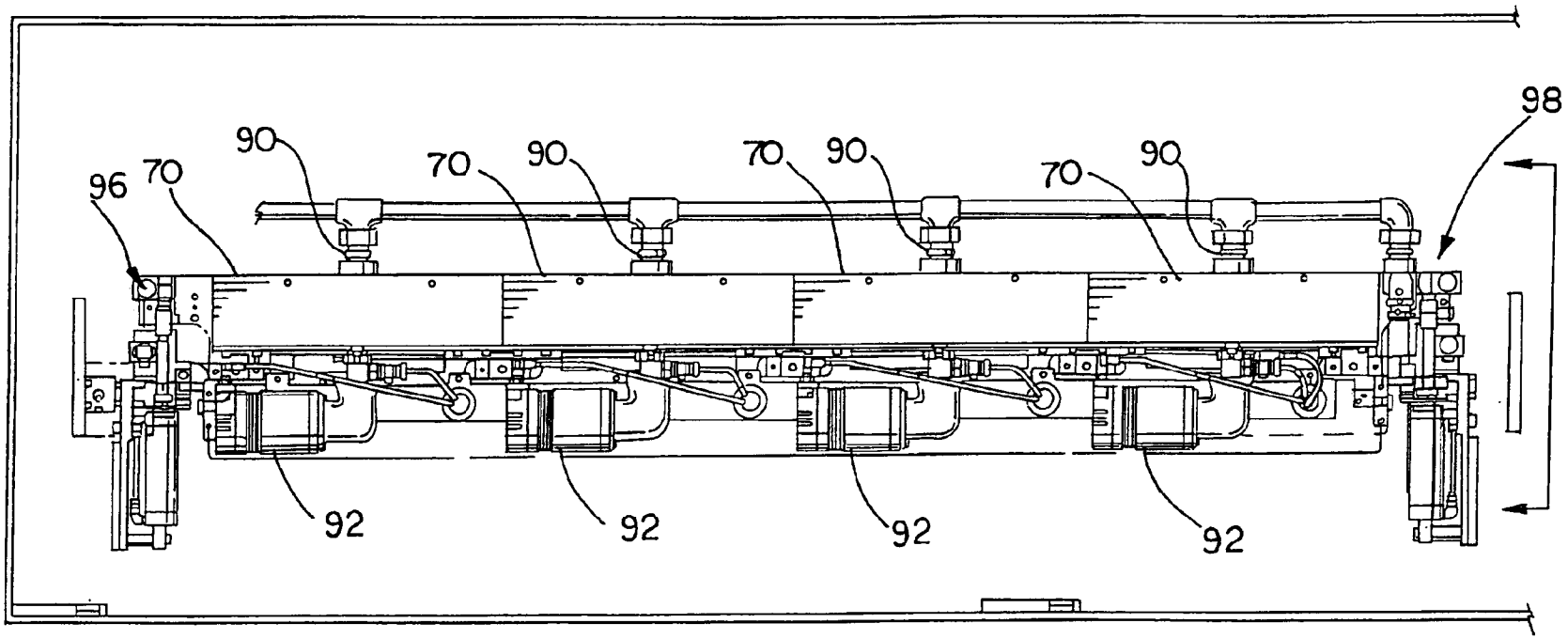
FIG. 4 is an elevational view taken along line 4—4 of FIG. 3 and illustrating an integrated ink supply system having four modular page packs.

Referring now to FIG. 4, the ink rail assembly 36 is shown taken along line 4—4 of FIG. 3. The ink rail assembly 36 preferably includes a number of modular page packs 70, with four such page packs 70 shown in FIG. 4. The page packs 70 can be those as described in detail in U.S. Pat. No. 5,472,324. As such, each page pack 70 can be approximately 12½" wide, such that the four page packs 70 can print a web of about 50".

The ink rail assembly 36 includes a first end 96, a second end 98, and a middle 99. The page packs 70 are mounted to the manifold 72, and extend along the length of the ink rail assembly 36 between the first end 96 and the second end 98. All of the page packs 70 may be secured directly to the manifold 72 via bolts. Each page pack 70 receives the ink via the ink inlet 90 and delivers the ink directly to the manifold 72 via several smaller outlets (not shown). In this manner, the ink does not travel through supply lines or hoses between the page pack 70 and the ink rail 74. The path traveled by the ink from the page pack 70 to the ink rail 74 is effectively minimized with respect to the prior art.

It will be noted that each such page pack 70 includes its own pump/motor 92, ink inlet 90, and valve 94 (See FIG. 2). Each of the individual ink inlets 90 may be connected to a single supply conduit 80 as is shown in FIG. 4. Alternatively, each of the individual ink inlets 90 easily may be connected to different ink supplies, such as different color ink supplies. In this setup, the print unit 32 can create different prints on the same web. Thus, four separate prints of 12½" each can be made. Further, the ink inlets 90 on the first end 96 may be attached to a first ink supply, while the ink inlets 90 on the second end 98 may be attached to a second ink supply. This can help to prevent a loss of ink pressure along the supply conduit 80.

It will be further understood that, depending on the dimensions for the contemplated application, additional or fewer modular page packs 70 may be employed as necessary. Thus, if a change is required such that a smaller web is used, a page pack 70 may be deactivated such that ink is not delivered to locations outside the web.

While in this example a specific page pack 70 is shown, it is clear that any item that receives ink from a supply and delivers it to an ink rail 74 serves the same function and could be used as a page pack.

The manifold is depicted in FIGS. 5*a*, 5*b*, 6, and 7. The manifold 72 includes a left end 100 and a right end 102, which can also be the first end 96 and the second end 98 of the ink rail assembly 36. The manifold 72 further includes a top side 104, a bottom side 106, and a middle 108. Disposed in the left end 100 and the right end 102 are threaded holes 110 (see FIGS. 5A and 6). These threaded holes 110 are used to mount the manifold 72 to the frame 34 of the print unit 32.

Figure 5A:
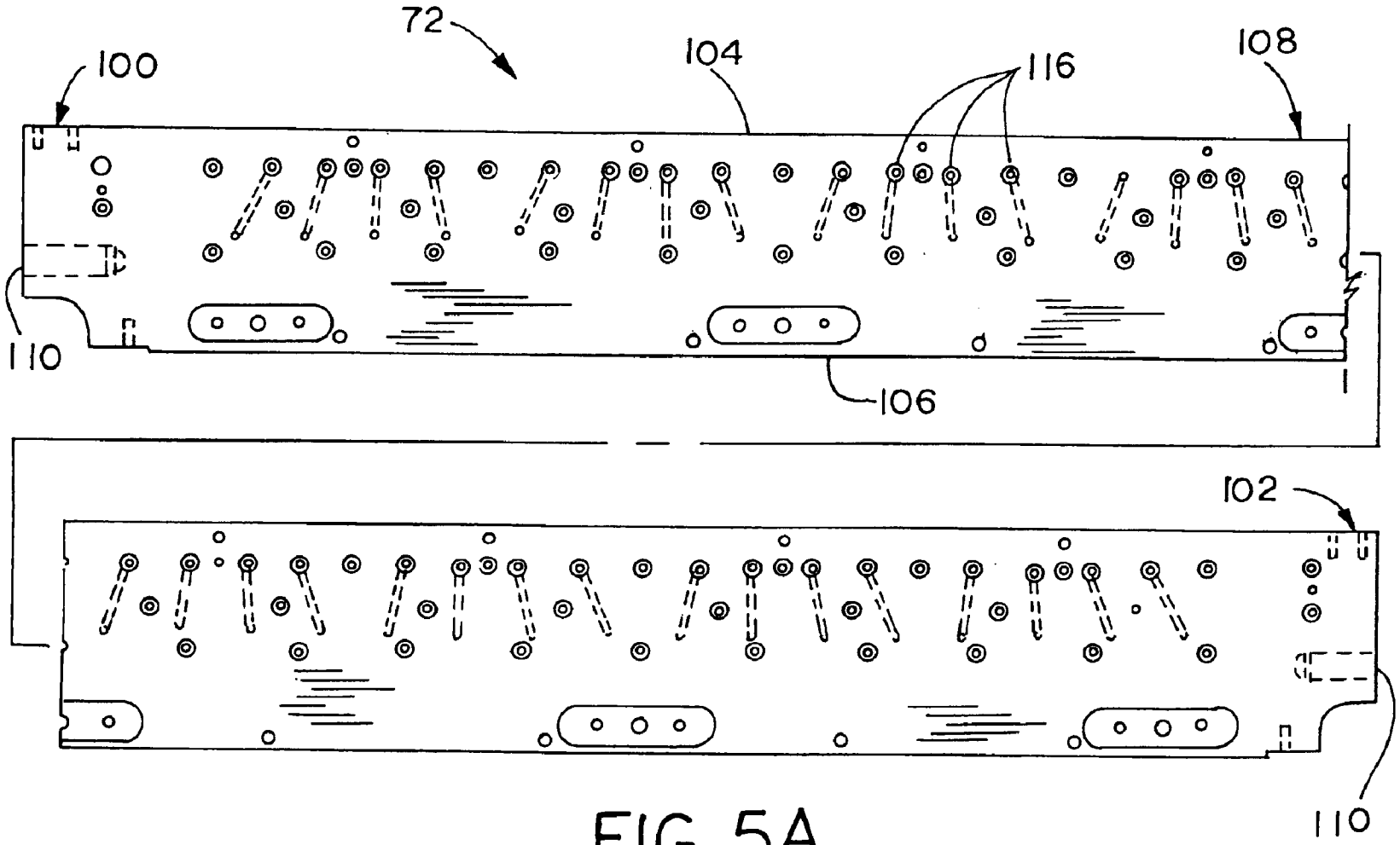
FIG. 5*a* is an elevational view of the ink input side of a manifold.

The manifold 72 further includes an inlet face 112, shown in FIG. 5A, and an outlet face 114. Disposed on the inlet face 112 are a plurality of ink inlets 116. Each inlet 116 is in fluid communication with a corresponding page pack outlet. Thus, the ink flowing out each individual page pack outlet is directed into a corresponding manifold inlet 116.

Figure 7:
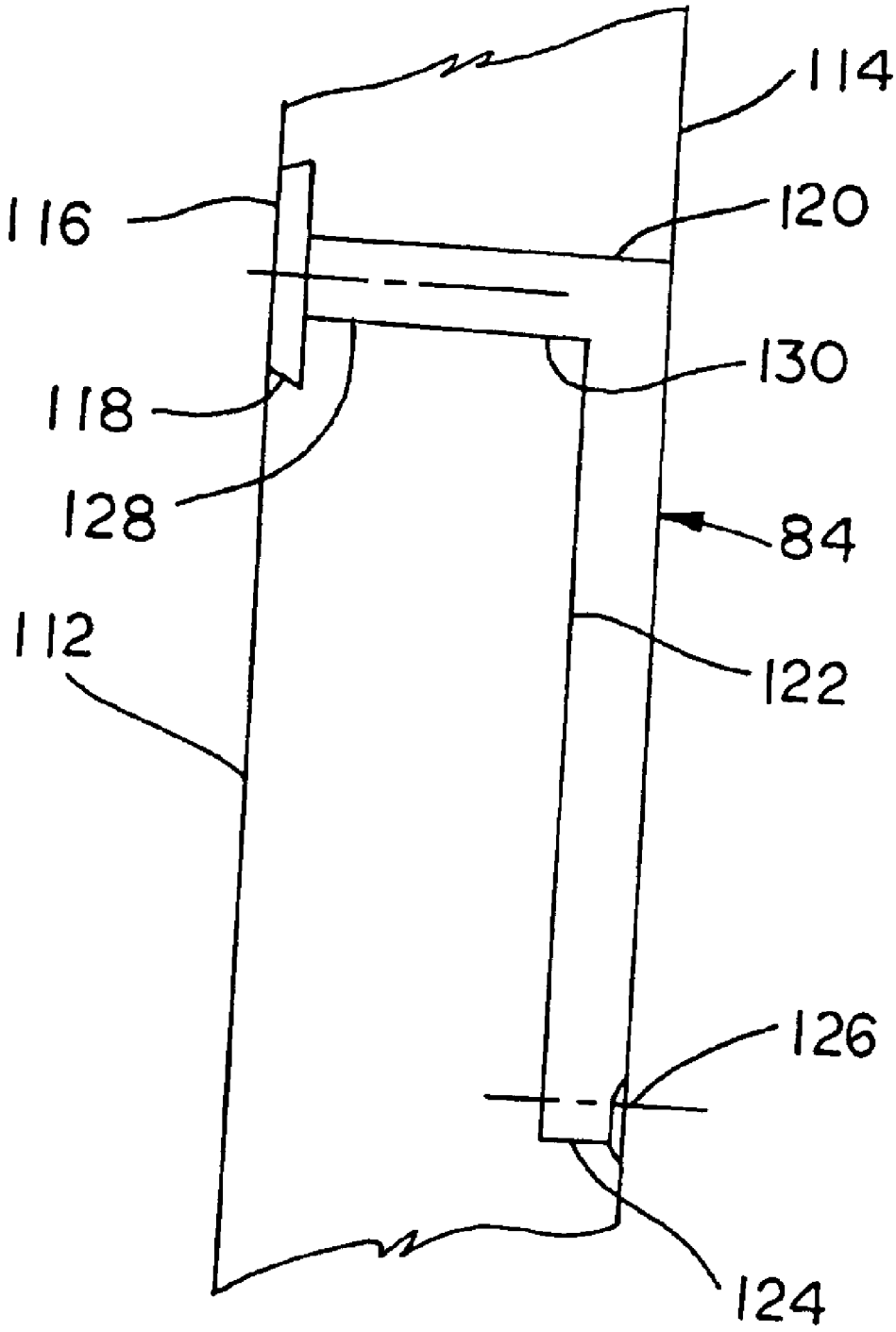
FIG. 7 is a partial cross-sectional view of the manifold.

The manifold 72 defines a series of ink paths 84, as seen in FIG. 7. Each ink path 84 includes a receiver 118 at the ink inlet 116, a conduit 120 disposed through the manifold 72, and a slot 122 disposed on the outlet face 114. The receiver 118 can be coaxial with the conduit 120, and can have a wider diameter than the conduit 120. The receiver 118 can also be wider than the corresponding page pack outlet. In this manner it is ensured that no portion of the page pack outlet is disposed against the inlet face 112 of the manifold 72, and all ink is easily transferred from the page pack outlets to the manifold inlets 116.

The conduit 120 can be disposed directly across the width of the manifold 72, approximately perpendicular to the inlet face 112, and can open into a slot 122 disposed on the outlet face 114 of the manifold 72. In this example, the slots 122 are disposed in a downward direction toward the bottom side 106. In this example, the slots 122 are further disposed in an outward direction away from the middle 108 of the manifold 72. The slots 122 each include a bottom portion 124 which can be generally circular and defines the manifold ink outlet 126.

In this example, the four page packs 70 have a length shorter than the length of the ink rail 74. The manifold 72 accommodates this by serving as an adaptor to transfer the ink from the narrower dimension of the page packs 70, through the conduits 120 and the outward-directed slots 122 to the wider dimension of the ink rail 74. In another example, the ink rail 74 may be longer than the page packs 70. In this example, the slots 122 could be disposed in a direction away from the middle 108 of the manifold 72.

Further, instead of a conduit 120 substantially perpendicular to the ink inlet face 112 followed by a slot 122 parallel to the ink inlet face 112, a conduit 120 could be formed in the manifold 72 at an angle to the ink inlet face 112, with a first end 128 of the conduit 120 at the ink inlet 116, and a second end 130 of the conduit 120 at the ink outlet 126, thereby duplicating the path of the perpendicular conduit 120 and the slot 122 with a single conduit 120. This would shorten the path of ink travel and lessen the resistance to flow, however it would be more difficult to machine. Further, the slots 122 could also be disposed in the ink outlet face 114.

Figure 5B:
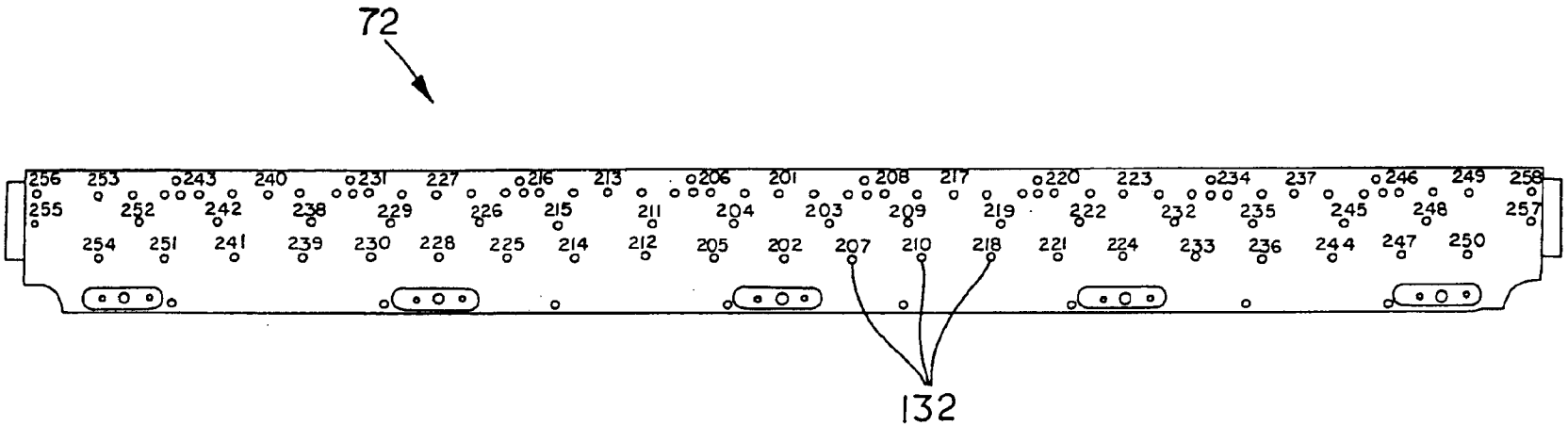
FIG. 5*b* is a torquing sequencing for the mainfold fasteners.
Figure 6:
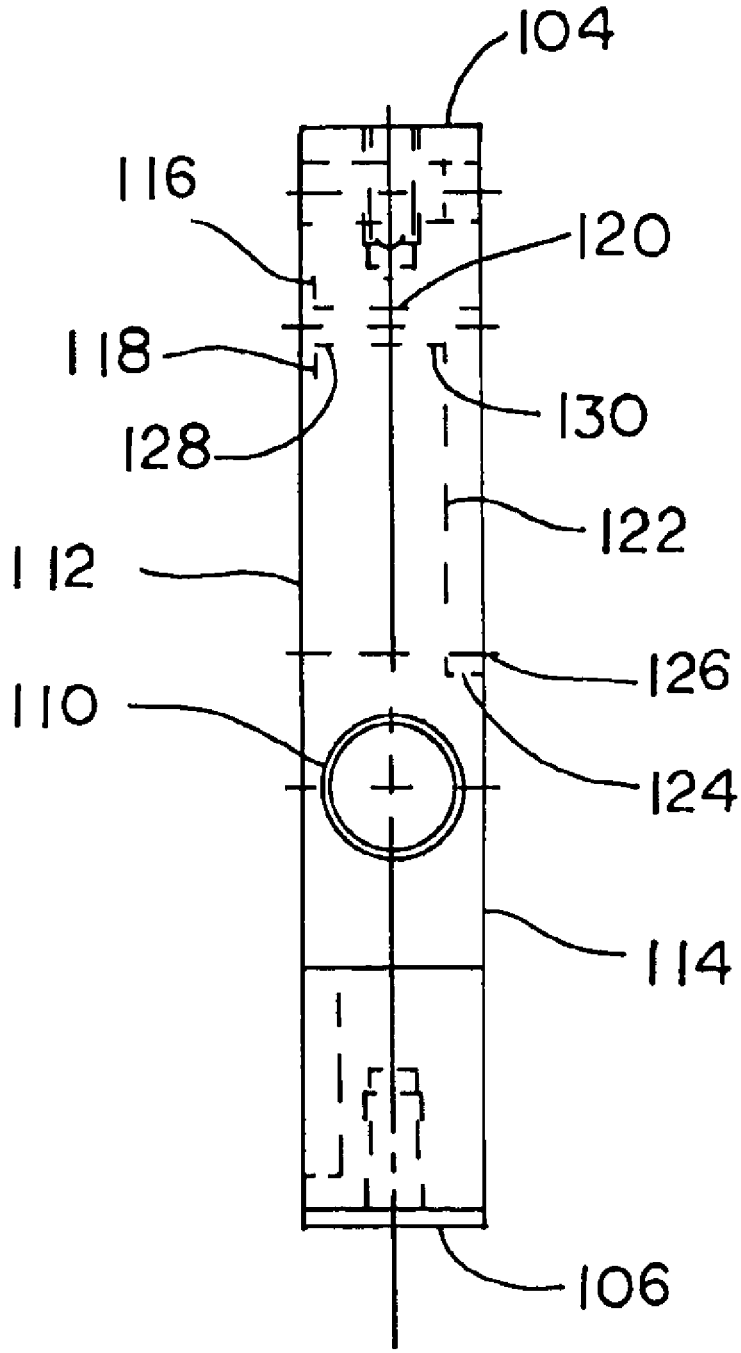
FIG. 6 is an end view of the manifold.

FIG. 5B discloses the mounting hole pattern of the manifold 72 and the ink rail 74. Each mounting hole 132 shows a 200-series number next to it, which reflects the sequence in which the fasteners should be secured. For example, the hole indicated 201 should be fastened first, the hole indicated 202 should be fastened second, etc. It has been found that the manifold 72 and the ink rail 74 can be assembled together without the use of gasketing if this sequence is followed. However, gasketing can of course be used, if desired or if any flaws exist in the surfaces of the manifold 72 or the ink rail 74.

Figure 10:
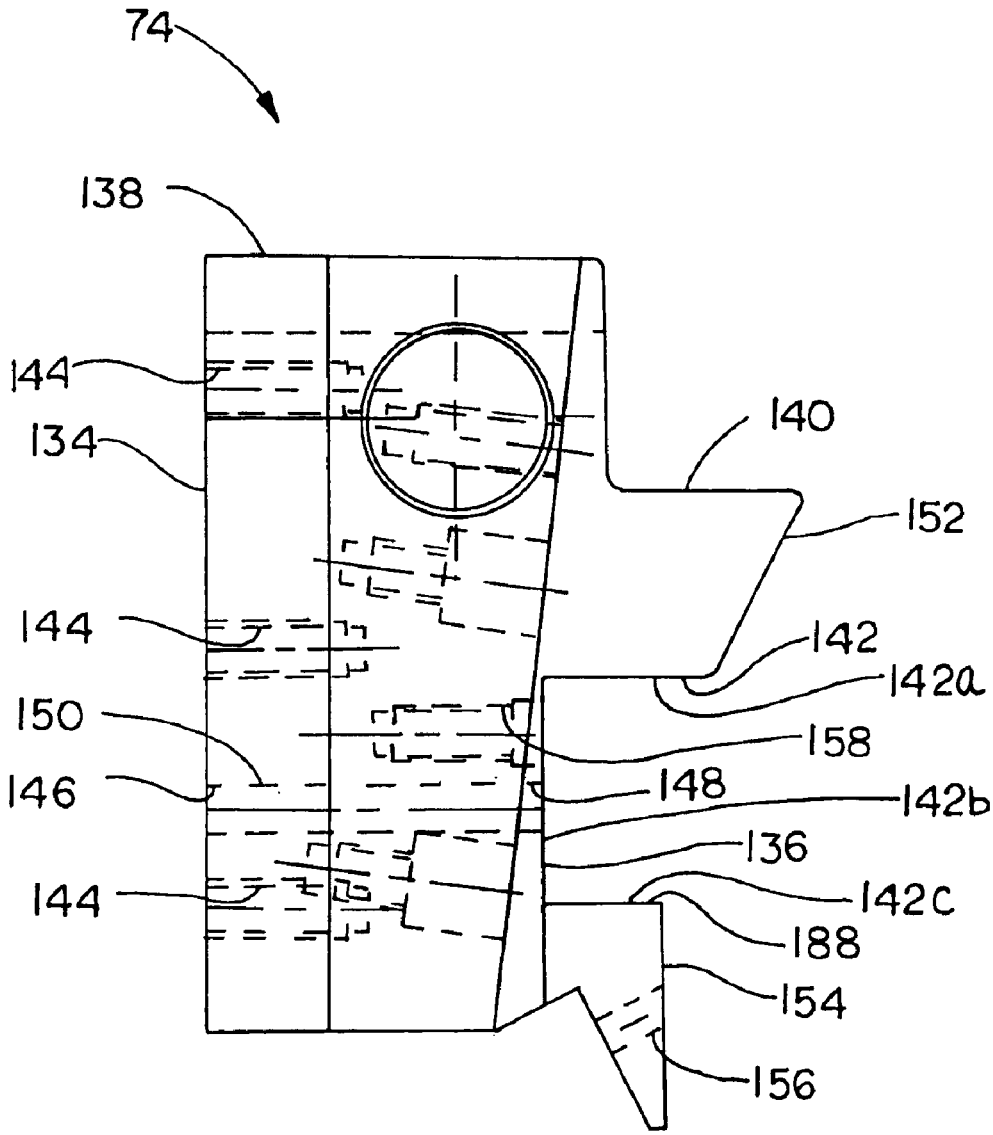
FIG. 10 is a right side view of the ink rail.
Figure 11:
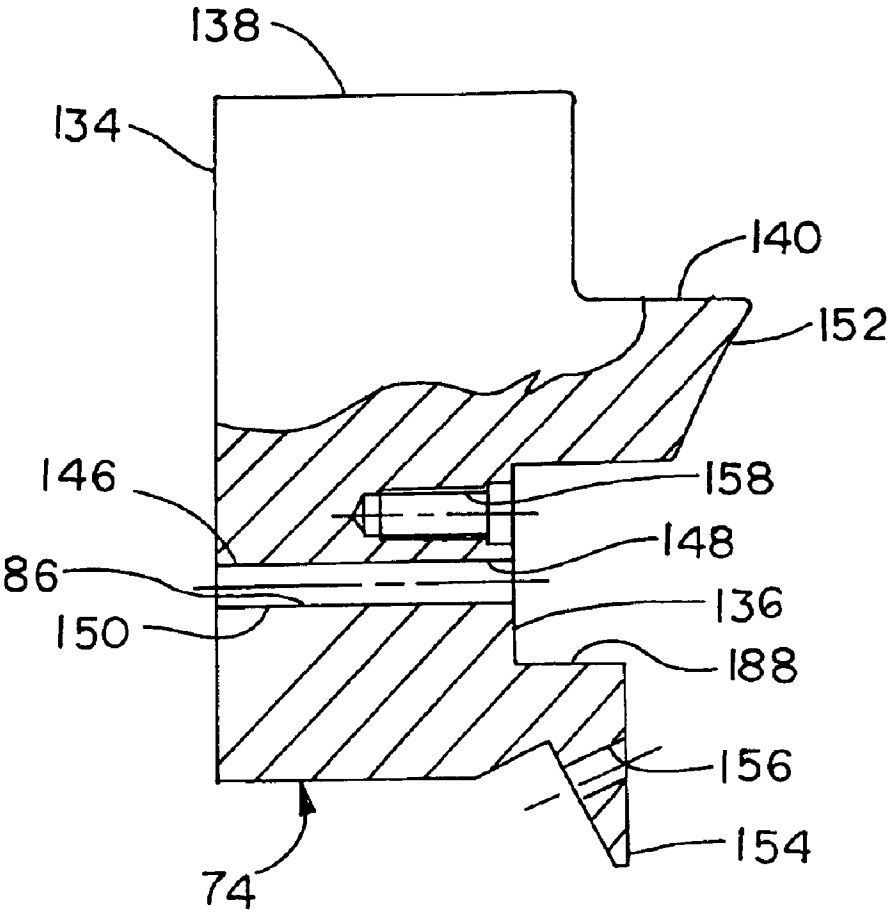
FIG. 11 is a sectional view of the ink rail taken along line 11—11 of FIG. 8.
Figure 13:
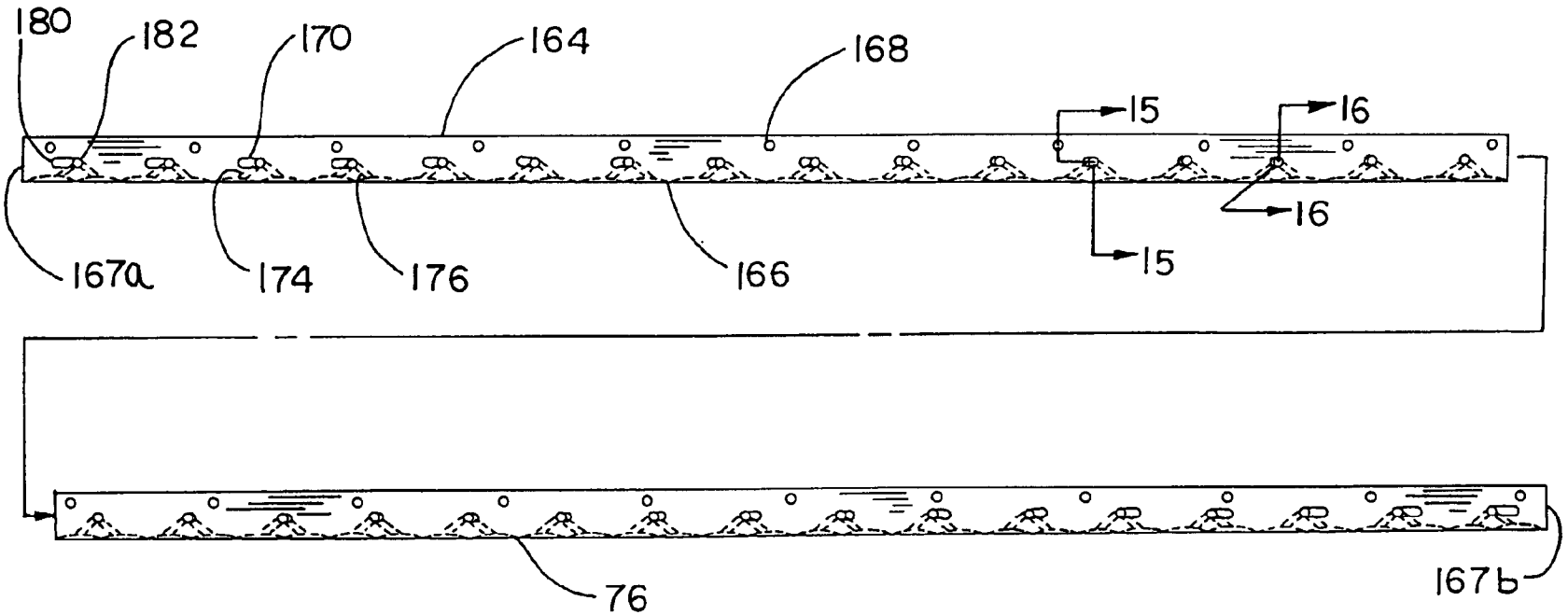
FIG. 13 is an elevational view of an orifice plate.
Figure 14:
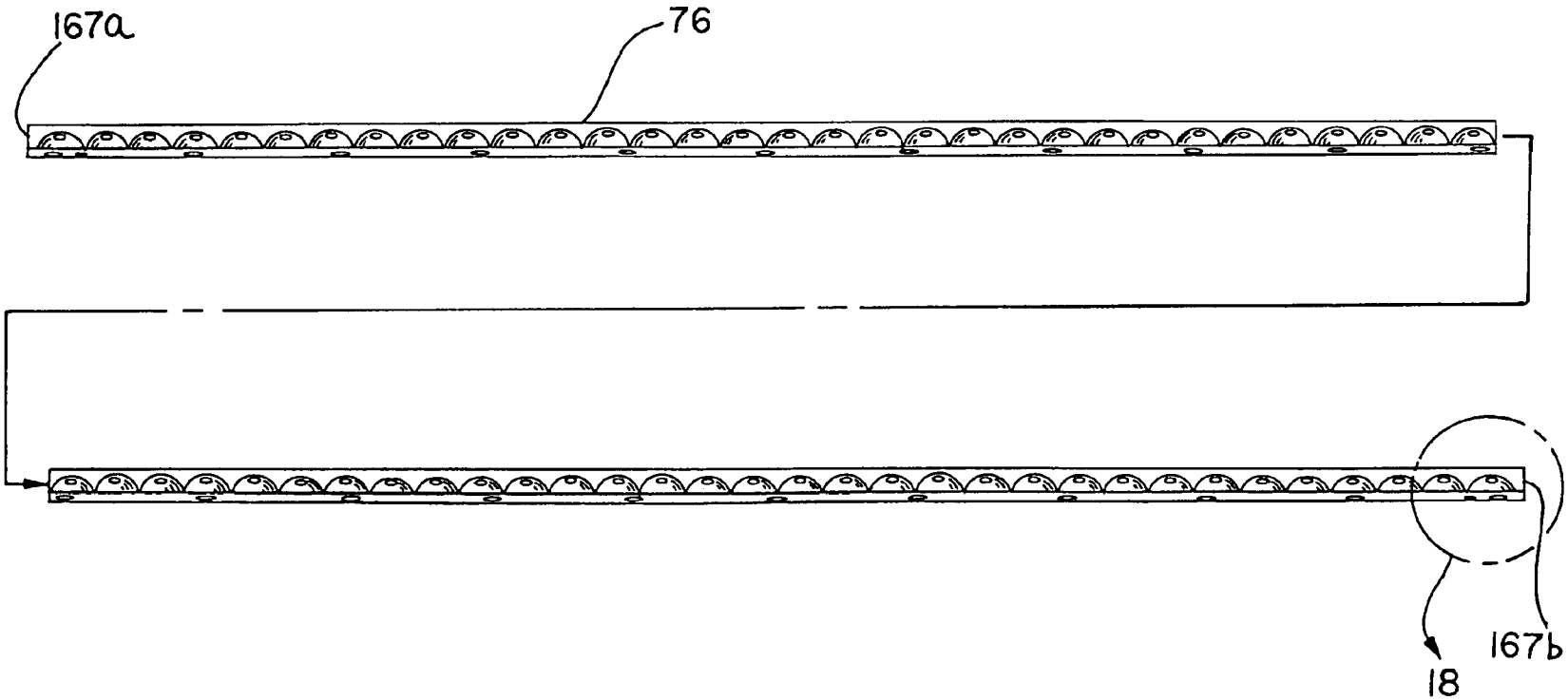
FIG. 14 is a bottom view of the orifice plate.

The ink rail 74 is depicted in FIGS. 8, 9, 10, 11, and 12. The ink rail 74 includes an ink inlet face 134 and an outlet face 136, as best seen in FIG. 11. It will be appreciated that the ink inlet face 134 is configured for attachment to the manifold 72. The ink rail 74 further includes a support portion 138, a drum receiver portion 140, and an orifice rail receiver 142 disposed in the drum receiver 140. The orifice rail receiver 142 is formed by cooperating faces 142*a*, 142*b*, and 142*c* (see FIG. 10). The orifice rail receiver 142 generally extends along the length of the drum receiver portion 140. The drum receiver portion 140 does not extend the entire length of the ink rail assembly 36, but instead extends between drum receiver ends 140*a* and 140*b*.

Figure 7B:
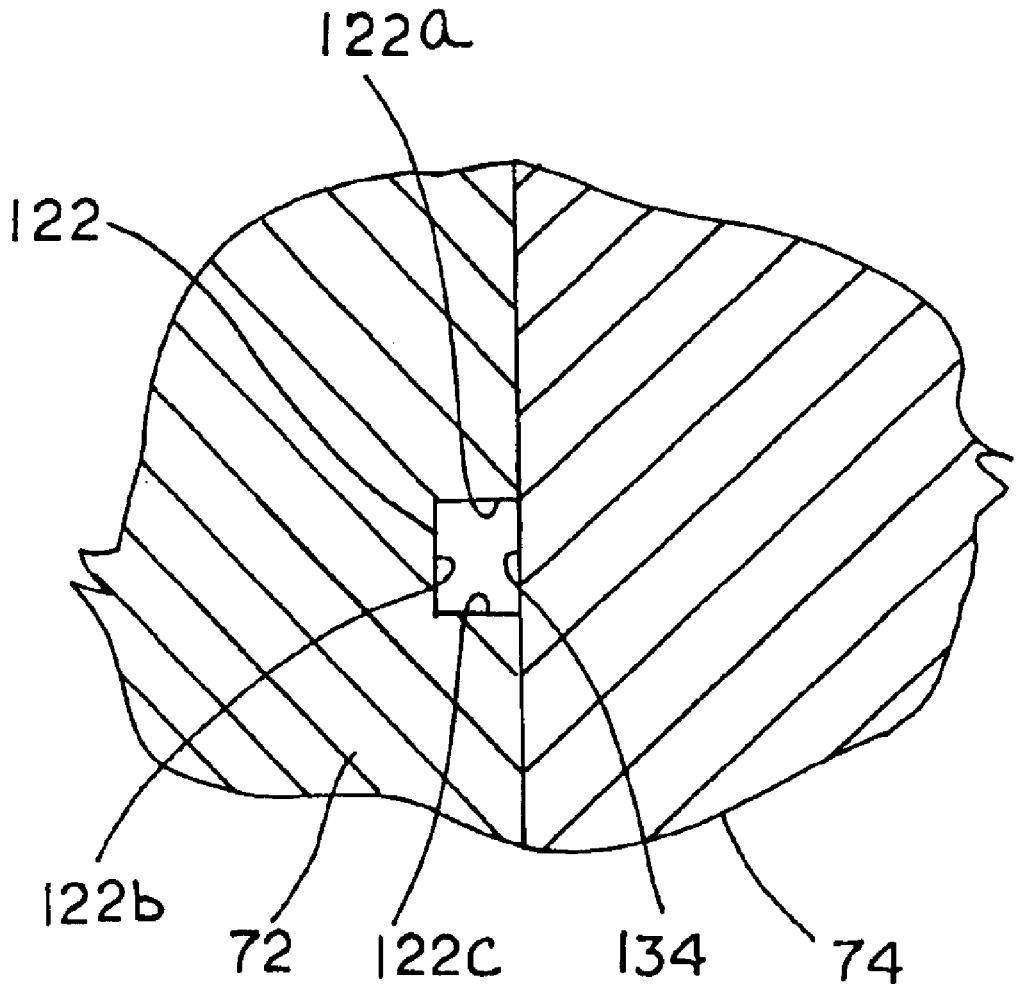
FIG. 7*b* is a fragmentary cross sectional top view of the manifold and ink rail taken along line 7*b*—7*b* in FIG. 3.
Figure 8:
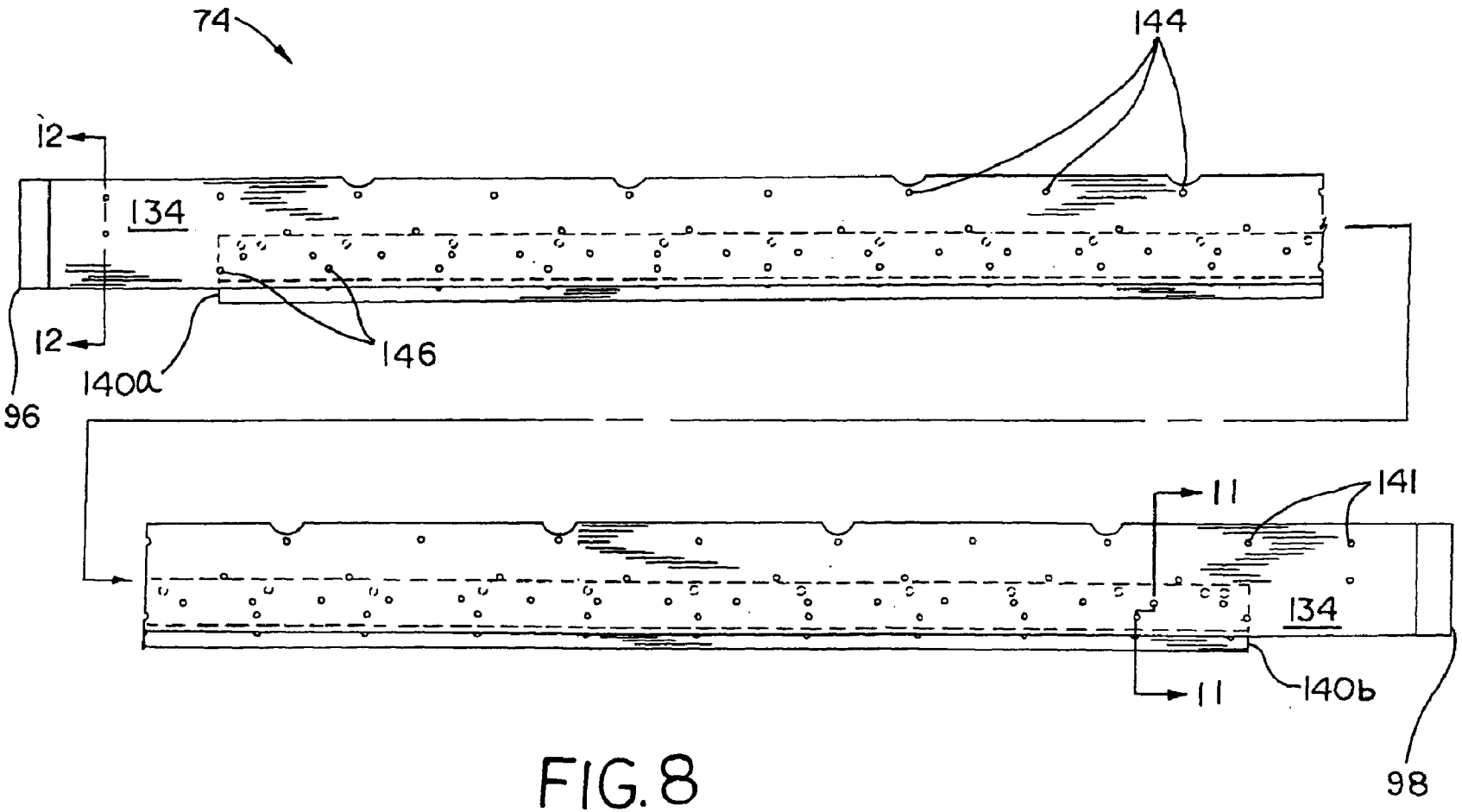
FIG. 8 is an elevational view of an ink rail.
Figure 9:
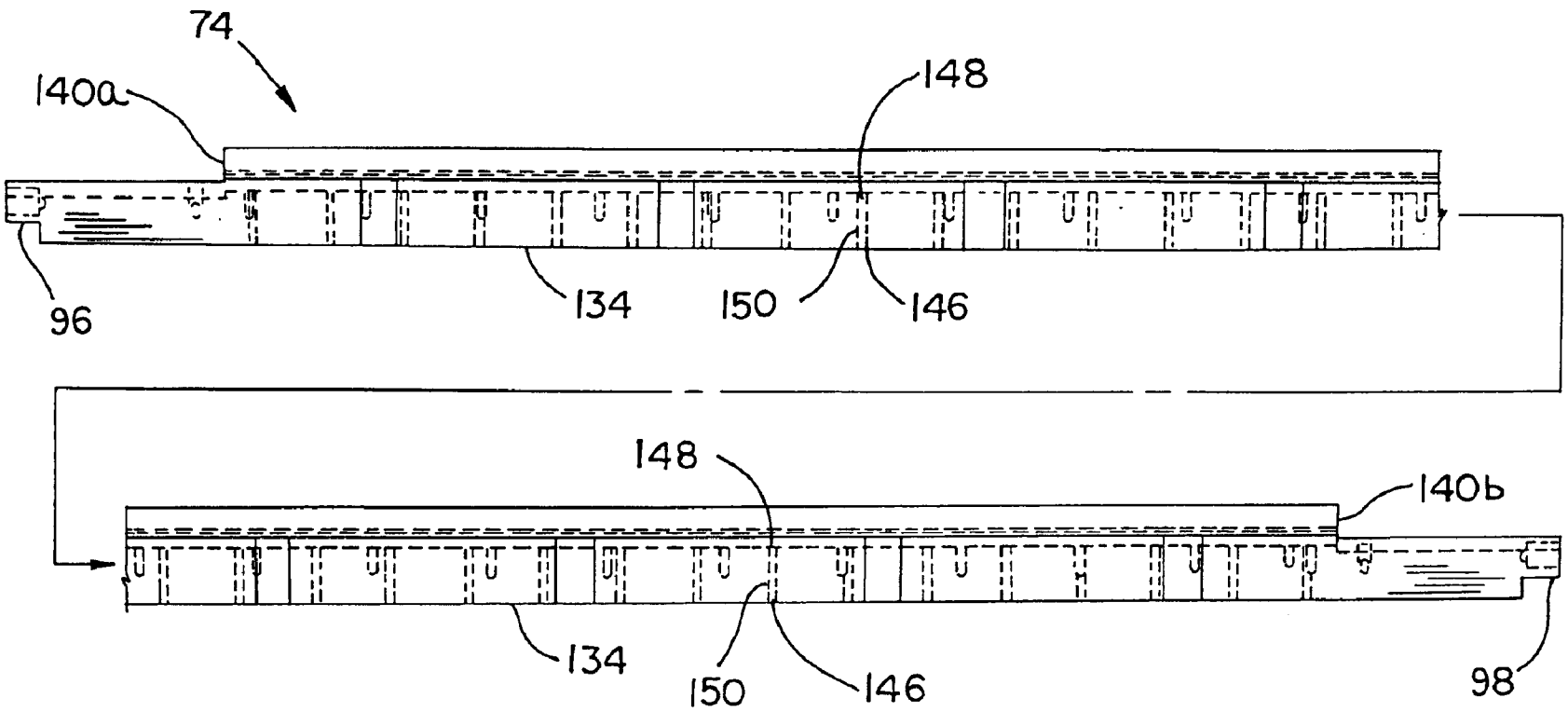
FIG. 9 is a top view of the ink rail.

The inlet face 134 and the support portion 138 include a plurality of threaded holes 144 that are used to mount the ink rail 74 to the manifold 72 (see FIG. 10). As is known in the art, threaded fasteners such as machine screws or any other suitable fasteners can be used. Because the ink inlet face 134 is disposed directly against the manifold outlet face 114 and the slots 122, the ink inlet face 134 serves to seal the manifold slots 122 in the manifold outlet face 114 (see FIG. 7*b*). In other words, the slots 122 create three faces 122*a*, 122*b*, and 122*c* of a rectangular tube, and the ink rail inlet face 134 creates the fourth, thereby creating a closed tube defined by the slot 122 and the ink inlet face 134. As an alternative, the manifold 72 and ink rail 74 can be integrally formed.

The ink rail 74 further includes an ink path 86 with an inlet 146 and an outlet 148 defined by a conduit 150 (see FIG. 11). The ink inlet 146 is in fluid communication with the manifold ink outlet 126. In this example, the conduit 150 travels the width of the ink rail 74 perpendicular to the ink inlet face 134. The ink outlet 148 is disposed adjacent the orifice rail receiver 142 and is configured to deliver ink to the orifice rail 76.

The drum receiver 140 includes a top portion 152 and a bottom portion 154. The top portion 152 is configured to smooth the ink on the drum 40 as the drum 40 rotates past. The bottom portion 154 includes a through hole 156 to which a knife (not shown) can be mounted. The knife can be used to make abutting contact with a surface of the drum 40 during operation of the press to scrape excess ink from the drum 40 as is known in the art.

An orifice rail receiver 142 is disposed between the upper portion 152 and the lower portion 154 of the drum receiver 140 (see FIG. 11). The orifice rail receiver 142 is adapted to receive the orifice rail 76, and inclues a plurality of threaded holes 158 which receive fasteners that secure the orifice rail 76 against the ink rail 74.

Figure 12:
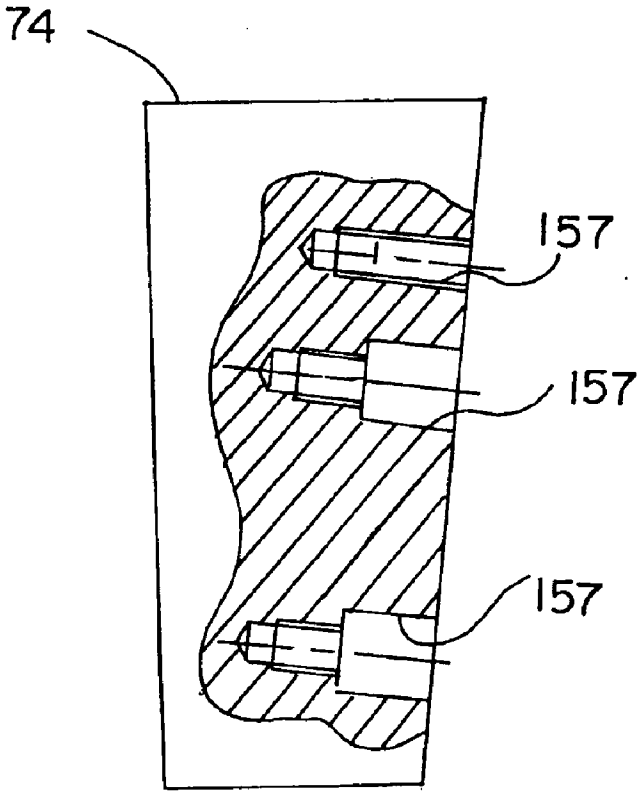
FIG. 12 is a sectional view of the ink rail taken along line 12—12 of FIG. 8.

As explained earlier, the drum receiver 140 extends between drum receiver ends 140*a* and 140*b*, but not fully to the first end 96 and the second end 98 of the ink rail assembly 36. As shown in FIG. 12, near the ends 96, 98 of the ink rail 74 beyond the ends 140*a* and 140*b* of the drum receiver 140, the ink rail 74 includes threaded mounting holes 157. These mounting holes 157 may be used as is known in the art to attach various items such as drum guides that can be helpful in the operation of the printing press 30.

The orifice rail 76 is depicted in FIGS. 13–18. The orifice rail 76 includes an ink inlet face 160 and a drum face 162 opposite the ink inlet face 160 (see FIG. 15). The orifice rail 76 also includes a top side 164 and a bottom side 166. In the orifice rail 76, the bottom side 166 is also the ink outlet face. The orifice rail 76 also includes ends 167*a* and 167*b*, that, when mounted to the ink rail, are coincident with drum receiver ends 140*a* and 140*b* (see FIGS. 13 and 14).

Figure 15:
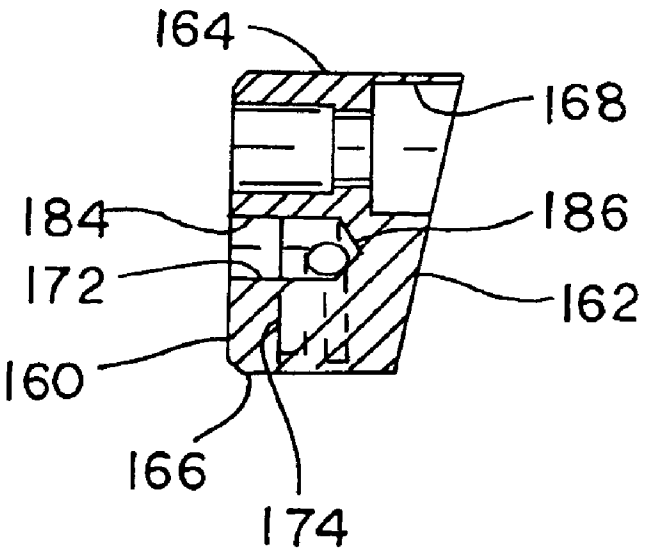
FIG. 15 is a cross sectional view of the orifice plate taken along line 15—15 in FIG. 13.

Disposed in the orifice rail 76 from the drum face 162 to the ink inlet face 160 is a plurality of counter-bored through holes 168 (see FIG. 15). These holes 168 are used to fasten the orifice rail 76 to the threaded holes 158 in the ink rail 74.

Figure 16:
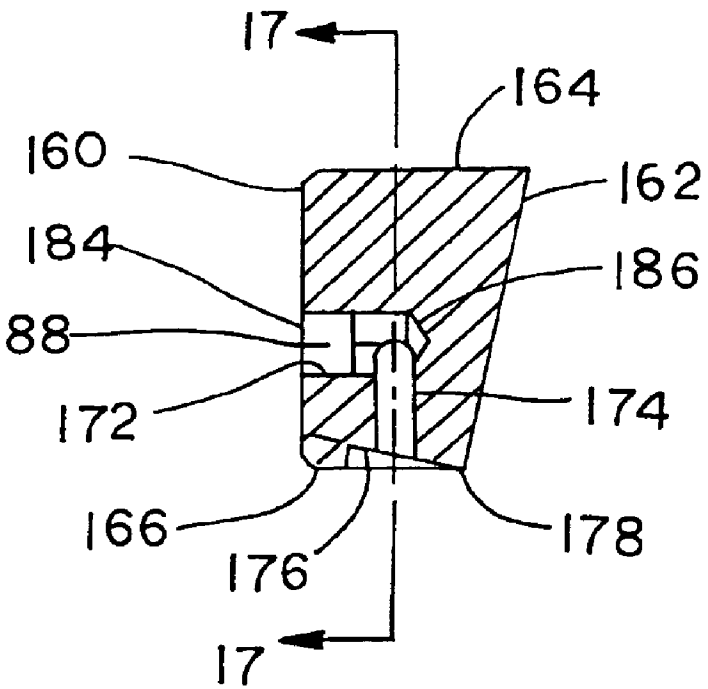
FIG. 16 is a cross sectional view of the orifice plate taken along line 16—16 in FIG. 13.

The orifice rail 76 includes an ink path 88 that transfers ink from the ink rail 74 to the drum 40 (see FIG. 16). The ink path 88 includes a plurality of slots 170 (shown best in FIG. 13), a conduit 172 (see FIG. 16) through the orifice rail 76, a pair of delivery ducts 174 extending down to the bottom 166 of the orifice rail 76 from each conduit 172, a scallop 176 at the end of each delivery duct 174 and a slit 178 through which the ink travels.

A plurality of slots 170 are disposed in the ink inlet face 160. The slots 170 each includes a first end 180 and a second end 182. The first end 180 of the slots 170 serve as an orifice ink inlet 184. Again, the slot 170 forms three faces of a rectangular tube, with the outlet face 136 of the ink rail 74 providing the fourth face, to create a sealed tube through which the ink can travel.

At the second end 182 of the slot 170, a conduit 172 is disposed in the orifice rail 76 and travels approximately midway through the width of the orifice rail 76 to a distal end 186. At the distal end 186 of each conduit 172, a pair of delivery ducts 174 extend downward and at an angle away from the distal end 186. Disposed at the bottom of each of the delivery ducts 186 is a scallop 176 carved into the bottom 166 of the orifice rail 76. The scallop 176 is sealed along its open bottom by a sealing face 188 on the bottom portion 154 of the ink rail 74 (See FIG. 11). However, a small slit 178 exists between the sealing face 188 and the scallop 176 adjacent the drum 40 such that ink can exit the scallop 176 and be deposited on the drum 140. It has been found that a slit 178 with a width of 0.020" is sufficient.

Figure 18:
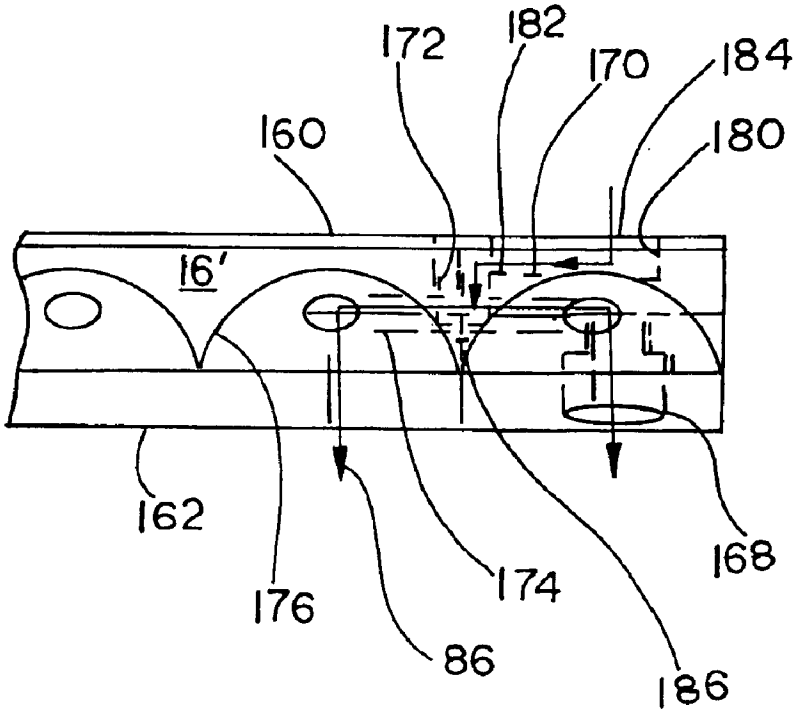
FIG. 18 is a detail view of the bottom of the orifice plate taken along line 18 in FIG. 13.
Figure 17:
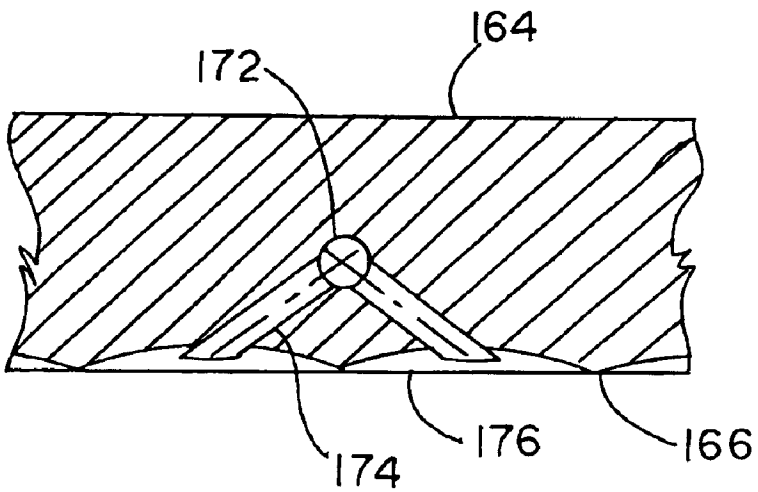
FIG. 17 is a partial cross sectional view of the orifice plate taken along line 17—17 in FIG. 16.

Thus, as shown in FIG. 18, ink travels along the orifice rail ink path 86 from the ink rail 74 into the orifice inlet 184 at the first end 180 of the slot 170. Ink travels down the slot 170, through the conduit 172, and through the delivery ducts 174 into the scallops 176, thereby filling them up. The ink then travels through the slit 178 and is delivered onto the rotating drum 40 where it can be transferred to a web.

In the present example, the slots 170 are directed inwards toward the middle 99 of the ink rail assembly 36 and the orifice rail 76. Thus, the slots 170 receive the ink in the first end 180, then direct the ink inwards towards the middle 99 of the print press 32. In this way, a surface of a web smaller than the ink rail 74 can be printed. In another example, the slots 170 could radiate outwards away from the middle 99 of the ink rail assembly. In such an example, the web upon which is printed could be wider than the ink rail 74.

An ink rail assembly 36 in accordance with the disclosed example offers one or more advantages over conventional arrangements. These advantages may include, by way of example rather than limitation, one or more of the following. The web width may be adjusted simply by replacing the orifice rail 76. Different orifice rails 76 can be employed having different slot lengths 170. Slots 170 extending inward with a longer length can create a narrower print. It has been found that a print face with up to four inches adjustment (i.e. +/−2 inches) can be achieved. This results in substantial savings as it is far less expensive to have one ink rail 74 with several orifice rails 76 than maintaining several ink rails 74. Further, it is far easier to replace the small and lightweight orifice rail 76 than the large and cumbersome ink rail 74. The slotted manifold 72 can further alter the width of the delivered ink via its slots 122.

Moreover, each ink rail assembly 36 has a very short ink pathway when compared conventional arrangements. Thus, when changing from one color to another, the ink in the print unit 32 can be purged very quickly, resulting in faster changeover time, a reduction in wasted ink, and a reduction in environmental disposal costs.

Also, according to the disclosed example, the present system offers a significant reduction in the length and number of supply hoses, with fewer fittings and fewer possible leak sources. This arrangement significantly reduces maintenance time and costs. Further, because each page pack 70 has its own individual pump/motor 92, should one of the units fail only that individual module needs to be replaced, which is significantly cheaper and easier to replace than the entire ink rail assembly 36.

Finally, the modular arrangement of the page packs 70 permits a paper web having a 50" (fifty inch) web width to be divided into four (4) pages. Due to the modular and integrated arrangement in which each page pack 70 has its own ink supply, each page may be printed in a different color.

From the foregoing, one of ordinary skill in the art will appreciate that the present disclosure sets forth a printing press 32 with an adjustable orifice rail 76 and modular page pack 70. However, one of ordinary skill in the art could readily apply the novel teachings of this disclosure to any number of situations in which it is desirable to increase the flexibility of a print unit. As such, the teachings of this disclosure shall not be considered to be limited to the specific examples disclosed herein, but to include all applications within the spirit and scope of the invention.

I claim:

1. An integrated ink rail assembly with a left end, a right end, and a middle, comprising:

a page pack including an ink inlet adapted to receive ink from an ink source and a pump adapted to pump the ink through an ink path, the page pack having an ink outlet face;

a manifold having an ink inlet face, the page pack being directly mounted to the manifold;

an ink rail mounted to the manifold; and an orifice rail mounted to the ink rail and adapted to deliver ink to a drum;

the page pack, manifold, ink rail, and orifice rail each including an ink passage, the ink passages defining the ink path between the ink source and the drum;

wherein the ink outlet face of the page pack is in confronting relationship with the ink inlet face of the manifold.

2. The ink rail assembly of claim 1, wherein multiple page packs are mounted to the manifold.

3. The ink rail assembly of claim 2 wherein each page pack is independently operable and removable.

4. The ink rail assembly of claim 3 wherein each page pack may be supplied by a separate ink source.

5. The ink rail assembly of claim 2, wherein the width of the multiple page packs is wider than the ink rail.

6. The ink rail assembly of claim 1, the page pack including a plurality of ink outlets.

7. The ink rail assembly of claim 6, the manifold including an ink inlet face and an ink outlet face.

8. The ink rail assembly of claim 7, the manifold including a plurality of ink inlets on the ink inlet face, the manifold ink inlets being in fluid communication with the page pack ink outlets.

9. The ink rail assembly of claim 8, the manifold including a plurality of manifold ink paths that each define a portion of a corresponding ink passage.

10. The ink rail assembly of claim 9, wherein at least one manifold ink path includes a slot in the manifold and a conduit through the manifold.

11. The ink rail assembly of claim 10, wherein the slots direct the manifold ink path towards the middle of the ink rail assembly.

12. The ink rail assembly of claim 10, wherein the slots direct the manifold ink path towards the left and right ends of the ink rail assembly.

13. The ink rail assembly of claim 1, the manifold including a plurality of ink inlets on the ink inlet face and a plurality of ink outlets on the ink outlet face.

14. The ink rail assembly of claim 13, the ink rail including an ink inlet face and a plurality of ink inlets on the ink inlet face, the ink rail ink inlets being in fluid communication with the manifold ink outlets.

15. The ink rail assembly of claim 13, each manifold ink inlet including a receiver.

16. The ink rail assembly of claim 1, wherein the manifold, ink rail, and orifice rail have no moving parts.

17. A print press, comprising:

a frame;

a drum mounted to the frame and adapted to receive and transfer ink;

a manifold with an ink inlet face and an ink outlet face rotatably mounted to the frame;

a page pack with an ink outlet mounted to the ink inlet face of the manifold;

an ink rail mounted to the ink outlet face of the manifold;

a first orifice rail and a second orifice rail, each of the first and second orifice rails selectively mountable to the ink rail and adapted to deliver ink to the drum;

the page pack, manifold, ink rail, and the selected orifice rail defining an ink path between the ink source and the drum; and an actuator configured to shift the manifold from a work position in which the orifice rail delivers ink to the drum to a service position in which the orifice rail is accessible;

wherein the first orifice rail includes an outwardly extending ink path wherein at least some of the ink traveling through the first orifice rail is directed outward away from the middle of the first orifice rail; and wherein the second orifice rail includes an inwardly extending ink path wherein at least some of the ink traveling through the second orifice rail is directed inward toward the middle of the second orifice rail.

18. The print press of claim 17, further including a coarse adjustment locator.

19. The print press of claim 18, wherein the coarse adjustment locator includes an extension in the frame, the extension including a slot, the actuator being slidable within the slot.

20. The print press of claim 17, further including a fine adjustment locator.

21. The print press of claim 20, wherein the fine adjustment locator includes a head and a strike plate.

22. The print press of claim 21, wherein the head is attached to a threaded rod, wherein the head is adjustable by rotating the threaded rod and locking the threaded rod with a nut.

23. The print press of claim 17, wherein the actuator is a hydraulic cylinder.

24. An adjustable ink rail assembly with a right end, a left end, and a middle, comprising:

an ink rail with an ink inlet face and an ink outlet face, a plurality of ink inlets and ink outlets, and an ink path fluidly connecting each ink inlet to an ink outlet; and an orifice rail with an ink inlet face and an ink outlet face, a plurality of ink inlets and ink outlets, at least one orifice rail ink inlet being in fluid communication with a corresponding ink rail ink outlet, an orifice rail ink path fluidly connecting each ink inlet to a corresponding ink outlet; the orifice rail being removably attached to the ink rail;

wherein ink traveling through the orifice rail ink passage is displaced axially with respect to the ink rail ink outlet; and wherein the orifice rail ink path includes a slot in the orifice rail ink inlet face.

25. The ink rail assembly of claim 24, wherein the ink rail ink outlet face seals the slot.

26. The ink rail assembly of claim 24, the orifice rail including a plurality of conduits disposed approximately perpendicular to the orifice ink inlet face, each conduit being in fluid communication with an end of a corresponding slot.

27. The ink rail assembly of claim 26, the orifice rail further including at least one delivery duct disposed downward in the orifice rail and in fluid communication with a corresponding conduit.

28. The ink rail assembly of claim 27, the orifice rail further including at least one scallop, disposed on the bottom of the orifice rail, and in fluid communication with a corresponding delivery duct.

29. The ink rail assembly of claim 28, wherein each scallop is bounded on the bottom by the ink rail.

30. The ink rail assembly of claim 29, wherein a slit is disposed between the ink rail and the scallop, the slit being adapted to deliver ink to a drum.

31. The ink rail assembly of claim 30, wherein the slit is approximately 0.020 inches wide.

32. An adjustable ink rail assembly with a right end, a left end, an a middle comprising:

an ink rail with an ink inlet face and an ink outlet face, a plurality of ink inlets and ink outlets, and an ink path fluidly connecting each ink inlet to an ink outlet;

an orifice rail removably attached to the ink rail, the orifice rail including an ink inlet face and an ink outlet face, a plurality of ink inlets and ink outlets, at least one orifice rail ink inlet being in fluid communication with a corresponding ink rail ink outlet, an orifice rail ink path fluidly connecting each ink inlet to a corresponding ink outlet;

wherein each orifice rail ink path includes a directional component either toward or away from the middle of the orifice rail, wherein at least some of the ink traveling through each orifice rail ink path is directed either toward or away from the middle of the orifice rail.

33. The ink rail assembly of claim 32, wherein the ink path displaces the ink towards the ends of the ink rail.

34. The ink rail assembly of claim 32, wherein the ink path displaces the ink towards the middle of the ink rail.

* * * * *

UNITED STATES PATENT AND TRADEMARK OFFICE

CERTIFICATE OF CORRECTION

PATENT NO. : 7,007,604 B2
APPLICATION NO. : 10/423426
DATED : March 7, 2006
INVENTOR(S) : Stanley Momot It is certified that error appears in the above-identified patent and that said Letters Patent is hereby corrected as shown below:

In the Claims:

At Column 8, line 29, “claim 3 wherein” should be -- claim 3, wherein --.

At Column 10, line 30, “an a middle” should be -- and a middle --.

Signed and Sealed this

Thirteenth Day of January, 2009

JON W. DUDAS
*Director of the United States Patent and Trademark Office*